United States Patent [19]

Kurogo

[11] Patent Number: 4,601,428

[45] Date of Patent: Jul. 22, 1986

[54] BURNER TIP

[75] Inventor: Haruji Kurogo, Tokyo, Japan

[73] Assignee: Tokyo Sangyo Kabushiki Kaisha, Tokyo, Japan

[21] Appl. No.: 677,946

[22] Filed: Dec. 4, 1984

[30] Foreign Application Priority Data

Dec. 9, 1983 [JP] Japan ..... 58-231436

[51] Int. Cl.[4] ..... B05B 7/06

[52] U.S. Cl. ..... 239/427.3; 239/434; 431/354

[58] Field of Search ..... 431/4, 354; 239/432, 239/434, 431, 427.3

[56] References Cited

U.S. PATENT DOCUMENTS

| | | | |
|---|---|---|---|
| 2,933,259 | 4/1960 | Raskin | 239/431 |
| 3,650,476 | 3/1972 | Rackley et al. | 239/432 X |
| 3,958,759 | 5/1976 | Timoney | 239/434 |
| 4,002,297 | 1/1977 | Pillard | 239/432 X |
| 4,249,885 | 2/1981 | Reich | 239/431 X |

FOREIGN PATENT DOCUMENTS

| | | | |
|---|---|---|---|
| 2147042 | 4/1972 | Fed. Rep. of Germany | 239/434 |
| 926428 | 5/1982 | U.S.S.R. | 239/434 |

*Primary Examiner*—Margaret A. Focarino
*Attorney, Agent, or Firm*—Murray Schaffer

[57] ABSTRACT

A tapered body having a hollow conical interior is provided with a central recess and an annular groove spaced outside the recess. The body has a number of jet ports opening on the tapered outer peripheral surface between the central recess and the annular groove. A first set of slots extending respectively between the jet ports and the central recess is provided as is a second set of grooves extending between said jet ports and said annular groove. A tapered flow divider is adapted to fit within said body to define therewith a mixing chamber. The flow divider has means for supplying fuel and a gaseous media to the mixing chamber and holes for feeding the mixture of fuel and gaseous media to the jet ports via the central recess and the annular groove and the first and second grooves.

5 Claims, 12 Drawing Figures

BURNER TIP

FIELD OF THE INVENTION

This invention relates to a burner tip which is to be used for boilers, heating furnaces, melting furnaces and other burning apparatus to promote the mixing of a liquid fuel with such spraying medium as air or steam, and provides the fine granulation of the liquid fuel and the perfect combustion of the fuel which is effective and economical in saving energy and preventing pollution.

BACKGROUND OF THE INVENTION

The fuel necessary to operate boilers, heating furnaces, melting furnaces and other burning apparatus under today's circumstances, tends to rise in price and lower in quality, making it desirable, therefore, to save energy and to prevent the effects of pollution. For this purpose, the fuel should burn well, that is, be low in the contents of $O_2$, soot and $NO_x$. It is known that these functions depend usually on the spraying characteristics of the fuel and its mixing characteristics with air.

In the conventional burning apparatus, not only is fuel used, but also a spraying medium such as air or steam is used to propel the fuel in a jet into the burner. When the spraying medium is jetted out of a nozzle, that is, jetted from the high pressure side to the low pressure side, it will mix with and finely granulate the fuel by the energy of the expanding spray.

However, since liquid fuel is an imcompressible fluid and has little dispersibility in itself, it is necessary to increase the degree of mixing of the spraying medium with it in order to promote the fine granulation of the liquid fuel. Generally, the amount of mixing of the spraying medium must be increased. Thus, this has been a defect in that any saving of fuel energy is lost in the mixing.

Further, particles in the spray fluctuate so much in their granularity as to be different in the rate of mixing with air for combustion and a favorable combustion is hard to attain. Therefore, the modification of the wind box and blower around the conventional burner has been costly.

Further, in order to attain low $NO_x$, apparatus has been proposed for slow combustion (such as exhaust gas recirculation, two-step combustion or divided flame combustion), water injection (reduction of efficiency by the evaporation of the latent heat of water) or de-nitrification. These steps also have the defect that the saving of energy is lost.

The burner tip of the present invention is made to eliminate such defects as are mentioned above. It changes the jet manner, promotes the mixing of a liquid fuel with such spraying medium as air or steam and produces the fine granulation of the liquid fuel and enables the combustion to be effective and economical to thereby save energy and prevent pollution.

BRIEF DESCRIPTION OF THE DRAWINGS

The drawings show an embodiment of the present invention. In the Drawings.

DETAILED DESCRIPTION OF THE INVENTION

Figure 1:
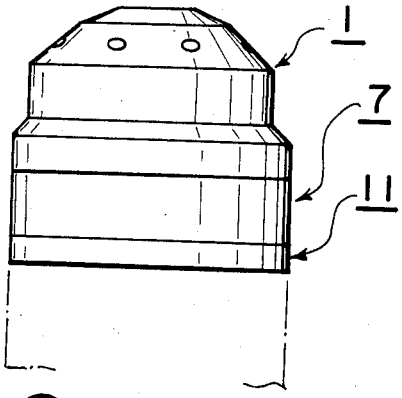
FIG. 1 is a side elevational view of a burner tip according to the present invention.

In the drawings, a burner tip body generally depicted by the numeral 1 is formed to be tapered and conically hollow and is provided with a recess 2 in the center of the interior of the tip. An annular recessed groove 3 is formed in the interior of the body at a proper spacing outside the recess 2, and a plurality of jet ports 4 opening on the tapered outer peripheral surface between the above mentioned recess 2 and annular recessed groove 3. Furthermore, on the inner surface of the tip body, communicating slots 5 are provided between the sides of the inner ends of the jet ports 4 and the above mentioned recess 2 and communicating slots 6 between the other sides of the inner ends of the above mentioned jet ports 4 and the circular recessed groove 3.

Figure 12:
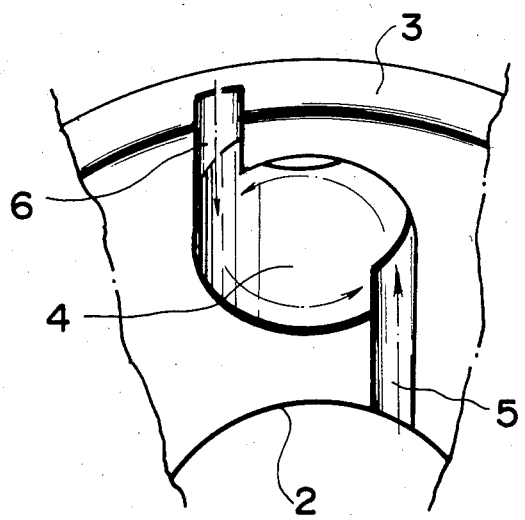
FIG. 12 is a magnified view of the inner end of a jet port of the burner tip body.

The arrangement of the communicating slots 5 and 6 at the inner ends of the respective jet ports 4 is such that the gaseous mixture enters tangentially to rotate in the port 4 whereby gaseous mixing is jetted out of the jet ports 4 as shown in detail in FIG. 12.

Figure 2:
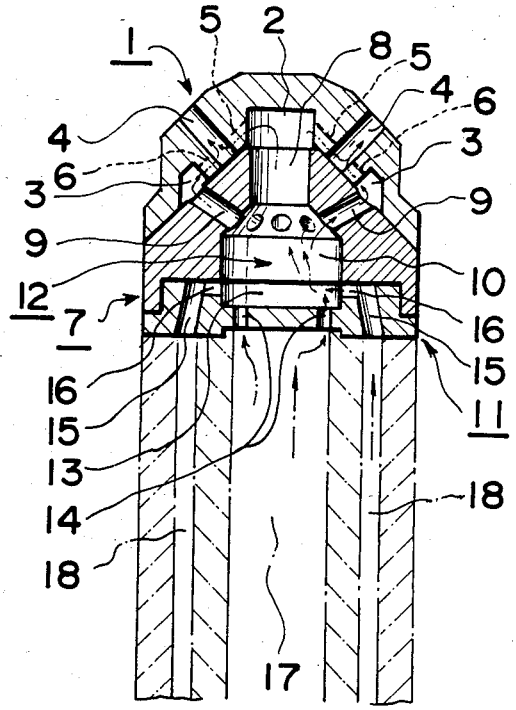
FIG. 2 is a vertically sectioned view of the same.
Figure 3:
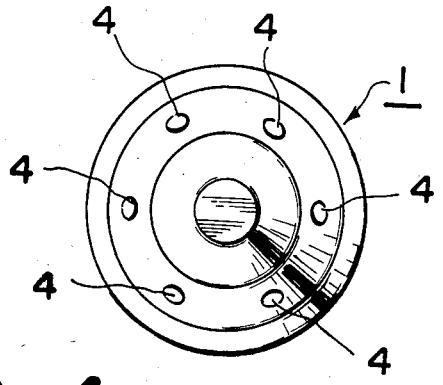
FIG. 3 is a plan view of the burner tip body.
Figure 4:
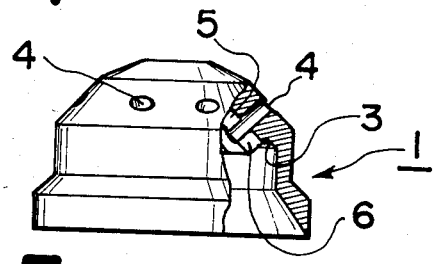
FIG. 4 is a partly sectioned elevation of the same.
Figure 5:
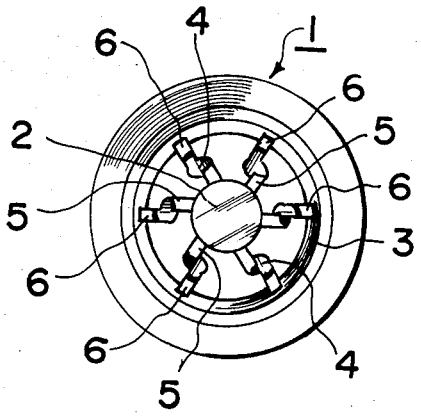
FIG. 5 is a bottom view of the same.
Figure 6:
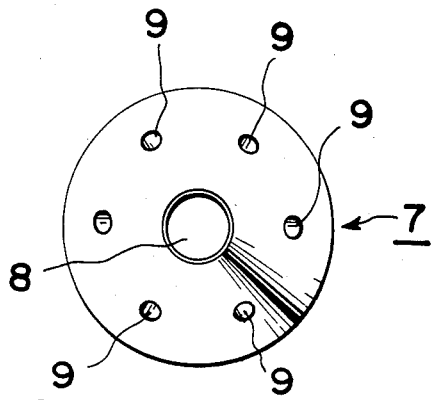
FIG. 6 is a plan view of a flow divider.
Figure 7:
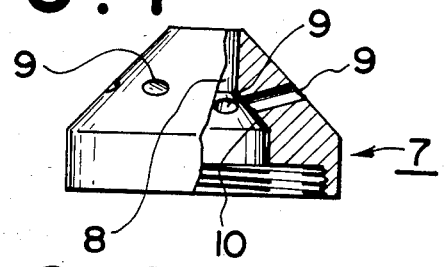
FIG. 7 is a partly sectioned elevation of the body shown in FIG. 6.
Figure 8:
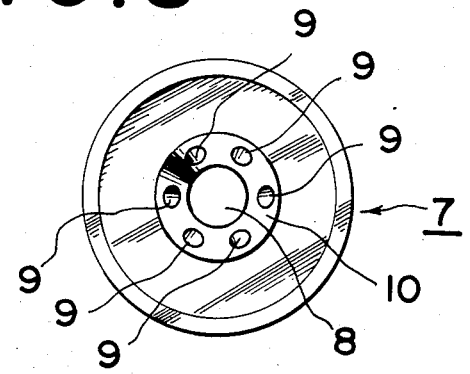
FIG. 8 is a bottom view of the same.

A flow divider 7, as is shown in detail in FIGS. 6, 7 and 8 is located in the burner tip body 1. As shown in FIG. 2, the flow divider 7 is shaped to be tapered to fit conformingly in the conical hollow interior with the recess 2, circular recessed groove 3, jet ports 4 and communicating slots 5 and 6 and is provided in its central part with a hole 8 communicating with the recess 2. The outer periphery of the flow divider 7 is provided with a proper number of holes 9 communicating respectively at their outer ends with the circular recessed groove 7 and at their inner ends with the central hole 8.

Figure 9:
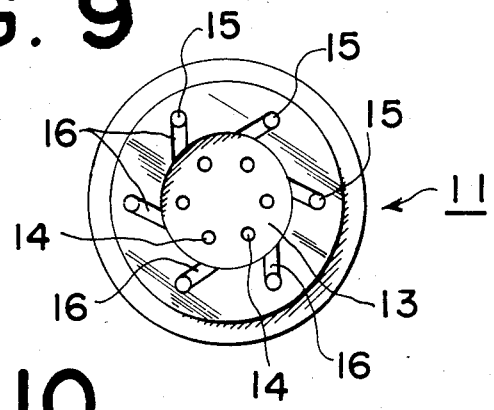
FIG. 9 is a plan view showing a plate for feeding a liquid fuel and spraying medium.
Figure 10:
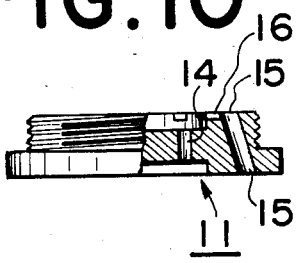
FIG. 10 is a partly sectioned elevation of the same.
Figure 11:
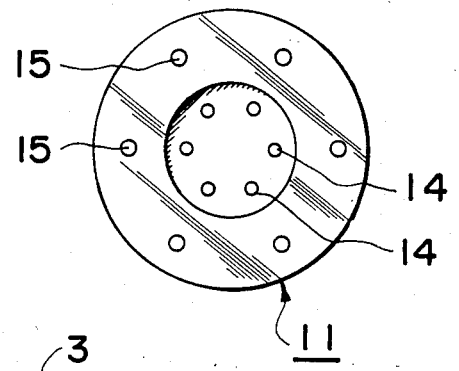
FIG. 11 is a plan view of the feeding plate.

In the illustrated embodiment, the interior of the flow divider 7 is enlarged to provide a cylindrical mixing chamber 10 communicating with the hole 8. A feeding plate 11, for feeding liquid fuel and spraying medium is abutted against the end of flow divider 7 enclosing the chamber 10. As shown in FIGS. 9, 10 and 11, the feeding plate 11 is provided with a recess 13 fitting the cylindrical chamber 10 of the flow divider 7 to form, therewith, the complete mixing chamber generally defined by the numeral 12. A plurality, or selected number of holes 14 for feeding a liquid fuel into the above mentioned mixing chamber 12 pass axially through plate 11. Outside and concentric to the periphery of the recess 13, there is provided a selected number of holes 15 for feeding a spraying medium such as air or steam. The plate 11 is provided on the interior frontal surface facing the flow divider 7, with a corresponding number of radial passages 16, communicating in a spiral direction between the holes 15, and the recess 13. By the way, holes 15 and communicating passages 16 are closed on the flow divider 7 side by the flow divider 7, itself.

A hollow conduit defining a liquid fuel feeding passage and a concentric 17 spraying medium feeding passage 18 are connected to the liquid fuel and spraying medium feeding plate 11 so that liquid fuel may be fed to the holes 14 and such spraying medium as air or steam may be fed to the surrounding holes 15.

As a result, as shown in FIG. 2, the liquid fuel will be fed vertically into the mixing chamber 12 from the holes 14, while the spraying medium will be fed horizontally and rotated into the mixing chamber 12 through the communicating grooves 16 from the holes 15 to form a gaseous mixture within the mixing chamber 12.

Incidentally, in the present invention, a gaseous mixture of liquid fuel and spraying medium may be fed directly into the chamber 10 on the interior surface of the flow divider 7. Therefore, the plate 11 for feeding the liquid fuel and spraying medium need not always be provided on the back surface of the flow divider 7 as shown in the drawings.

Nevertheless, in the above described embodiment and as ilustrated in the drawings, the liquid fuel and spraying medium feeding plate 11 is provided to jet the fuel and spraying medium through the co-axial conduits 17 and 18 respectively in streams which intersect substantially at right angles with each other and particularly to rotate the spraying medium via passage 16 entering the chamber 12 to thereby promote the mixing of the liquid fuel with the spraying medium.

The burner tip body 1, the flow divider 7, and the liquid fuel and spraying medium feeding plate 11 may be connected together by screw-threading or by welding selected parts together.

A gaseous mixture in which the liquid fuel is made into fine grains or mist will be formed by the expansion energy of the spraying medium and the rotation of the spraying medium itself caused by providing the communicating grooves 16 spirally with respect to the recess 13. The gaseous mixture will be divided by the flow divider 7 into two streams, one stream leading from the mixing chamber 12 to the central recess 2 of the burner tip body 1 through the hole 8; the other stream leading from the chamber 12 to the circular recessed groove 3 through the holes 9.

The gaseous mixture stream fed to the central recess 2 will then be fed to the side of the inner ends of the respective jet ports 4 through the respective communication groove 5, while the gaseous mixture stream fed to the circular recessed groove 3 of the burner tip body 1 will be fed to the other side of the inner ends of the respective jet ports 4 through the respective communicating grooves 6. The two streams recombine and mix further, in a spiral swirl and will be jetted of the jet ports 4 while being rotated as shown in FIG. 12.

As a result, the mixing and the fine granulation or misting of the liquid fuel will be further promoted and the gaseous mixture will be uniformly diffused over a wide range.

Therefore, a perfect combustion will be approached and a favorable combustion will be attained. Production of soot will be reduced, as will the $O_2$ content, and reduce the thermal loss of the exhaust gas. Thus, by the reduced $O_2$ content, the thermal efficiency will improve, the thermal $NO_x$ will be reduced to be as a whole low, and the rate of conversion from $SO_2$ to $SO_3$ will reduce to prevent corrosion at a low temperature.

As in the above, the present invention is effective and economical to save energy and prevent pollution.

Examples of the results of burning tests on the burner tip device of the present invention are shown in the following data which are comparisons of the same level of the smoke concentration (combustibility).

Data 1: Data in a boiler of a maximum evaporation of 200 t./hr. (which could evaporate a maximum of 200 tons of water per hour).

| | Conventional burner | Burner of present invention | Effects |
|---|---|---|---|
| Burner dimensions | 2.5 dia × 6 holes × 80 deg. | 2.5 dia × 6 holes × 80 deg. | |
| Burner type | Divided flame low $NO_x$ | Rotating flow jetting | |
| Number of burners used | 6 | 6 | |
| Fuel oil kind | Heavy oil C | Heavy oil C | |
| Combustion amount | 6,950 kg./hr. | 7,500 kg./hr. | |
| Smoke concentration | 2.3 deg. | 2.3 deg. | |
| Exhaust gas $O_2$% | 1.7% | 0.7% | Reduction by 59% |
| $NO_x$ concentration | 142 ppm. | 133 ppm. | Reduction of 9 ppm. |
| Economizer outlet gas temperature | 299 deg. C. | 292 deg. C. | Reduction of 7 deg. C. |
| Evaporation multiplication | 13.3 | 13.45 | Rise by 1.1% |

As is seen from the above data, $NO_x$ is lower with the burner tip of the present invention, the energy saving effect is higher by 1.1 percent in efficiency and the saving of the cost in a large boiler is much larger than with the conventional low $NO_x$ burner.

Further, with the conventional burner, auxilliary steam was used under a pressure of 11.5 kg./cm$^2$. G for the spraying medium, but with the burner tip of the present invention, the combustion state was kept sufficiently favorable enough under a pressure of 9.0 kg./cm.$^2$ G.

Data 2: Data in a boiler of a maximum evaporation of 30 t./hr. (which could evaporate a maximum of 30 tons of water per hour).

| | Conventional burner | Burner of present invention | Effects |
|---|---|---|---|
| Burner dimensions | 4.2 dia × 18 holes × 90 deg. | 4.2 dia × 16 holes × 90 deg. | |
| Burner type | Normal internal mixing | Rotating flow jetting | |
| Number of burners used | 1 | 1 | |
| Fuel oil kind | Heavy oil C | Heavy oil C | |
| Combustion amount | 1,480 lit./hr. | 1,580 lit./hr. | |
| Smoke concentration | 2.5 deg. | 2.6 deg. | |
| Exhaust gas $O_2$% | 6.4% | 4.1% | Reduction by 36% |
| $NO_x$ concentration | Not measured | Not measured | |
| Air heater outlet gas temperature | 184 deg. C. | 176 deg. C. | Reduction of 8 deg. C. |
| Thermal efficiency | About 88% | About 89.2% | Rise of 1.2% |

As shown by the numerical value of a furnace load of 1,260,000 kcal./m.$^3$, the combustion chamber of the boiler was so narrow as to be very difficult to improve combustion by prior art methods. However, with the burner tip of the present invention, combustion was improved and the effect of saving energy was attained.

Data 3: Data in a boiler of a maximum evaporation of 12 t./hr. (which could evaporate a maximum of 12 tons of water per hour).

| | Conventional burner | Burner of present invention | Effects |
|---|---|---|---|
| Burner dimensions | 4.4 dia × 7 holes × 65 deg. | 4.4 dia × 7 holes × 60 deg. | |
| Burner type | Normal internal mixing | Rotating flow jetting | |
| Number of burners used | 1 | 1 | |
| Fuel oil kind | Heavy oil C | Heavy oil C | |
| Combustion amount | 800 lit./hr. | 800 lit./hr. | |
| Smoke concentration | 2.0 deg. | 2.0 deg. | |
| Exhaust gas $O_2$% | 7.5% | 4.7% | Reduction by 37% |
| $NO_x$ concentration | 236 ppm. | 199 ppm. | Reduction of 37 ppm. |
| Furnace outlet gas temperature | 295 deg. C. | 262 deg. C. | Reduction of 33 deg. C. |
| Thermal efficiency | About 80% | About 83.6% | Rise of 3.6% |

As seen from the above, as compared with the conventional normal burner, the burner tip of the present invention is high, effectively reducing $NO_x$. When the burner tip of the present invention is used in a small boiler, the flames will be so short that the high temperature part of the flame will move readily from the boiler outlet to the furnace interior surface, therefore, the exhaust gas temperature will be very low and the efficiency will be very high.

Three examples of the test data have been shown in the above. In the light of the average with other data, the effect of reducing the $O_2$ rate is shown to be about 40 percent. Thus, the burner tip of the present invention requires no modification of the boiler, is cheap and contributes much to the industry by saving energy and preventing pollution.

I claim:

1. A burner tip comprising a tapered body having a hollow interior provided with a central recess and a circular groove spaced outside said recess, said tapered body having a number of jetting ports opening on the outer peripheral surface between the central recess and the circular groove and a first set of communicating grooves extending respectively between said jet ports and said recess and a second set of communicating grooves extending between said jet ports and said circular recessed groove, a flow dividing body having a hollow interior defining a mixing chamber and an exterior taper to fit within said body and provided with holes for feeding a gaseous mixture from said mixing chamber respectively to the recess and circular groove in said body.

2. A burner tip for mounting at the end of a conduit delivering fuel and a gaseous media comprising a body having a tapered exterior surface, a conical interior surface and a plurality of jet ports extending obliquely from the interior to the exterior surfaces, said interior surface having a central recess and an annular groove on the respective sides of said jet ports, a first set of slots connecting said central recess to each one of said jet ports and a second set of slots connect said annular groove to each one of said jet ports, a flow divider having an exterior surface conforming conically to the interior surface of said body and located therein, said flow divider defining a mixing chamber in communication with said fuel and gas conduit, and having a central opening from said mixing chamber to said central recess in said body and a plurality of bores extending from said mixing chamber to said annular groove.

3. The burner tip according to claim 2 wherein the slots of said first set and the slots of said second set are adapted to cause said mixture of fuel and gas to enter said jet ports rotatively.

4. The burner tip according to claim 2 wherein said flow divider includes a base plate having means for feeding said fuel and gas from said conduit to said mixing chamber at substantially right angles to each other.

5. The burner tip according to claim 4 wherein said means for feeding said gas comprises at least one passage way for feeding said gas spirally into said mixing chamber.

* * * * *

UNITED STATES PATENT AND TRADEMARK OFFICE

CERTIFICATE OF CORRECTION

PATENT NO. : 4,601,428

DATED : July 22, 1986

INVENTOR(S) : Haruji KUROGO

It is certified that error appears in the above-identified patent and that said Letters Patent are hereby corrected as shown below:

On the cover page, Item [73] should read:

--Assignee: Tokyo Sangyo Kabushiki Kaisha,
Tokyo, Japan; and

Kabushiki Kaisha Yoko,
Tokyo, Japan--

Signed and Sealed this

Eighteenth Day of November, 1986

*Attest:*

DONALD J. QUIGG

*Attesting Officer* *Commissioner of Patents and Trademarks*